United States Patent [19]

Pickles et al.

[11] 4,168,595

[45] Sep. 25, 1979

[54] WINDOW REGULATOR

[75] Inventors: Joseph Pickles, Birmingham; Nelson R. Weaver, Ypsilanti, both of Mich.

[73] Assignee: Ferro Manufacturing Corporation, Detroit, Mich. ; by said Joseph Pickles

[21] Appl. No.: 850,556

[22] Filed: Nov. 11, 1977

[51] Int. Cl.[2] ..... E05F 11/48

[52] U.S. Cl. ..... 49/352; 74/29; 74/422

[58] Field of Search ..... 49/325, 348, 349, 350, 49/352, 360; 74/29, 422

[56] References Cited

U.S. PATENT DOCUMENTS

| | | | |
|---|---|---|---|
| 3,281,991 | 11/1966 | Colell | 49/352 |
| 3,656,364 | 4/1972 | Cable et al. | 74/422 |
| 3,965,618 | 6/1976 | Pickles | 49/350 X |
| 4,004,371 | 1/1977 | Podolan et al. | 49/352 |

*Primary Examiner*—Philip C. Kannan

*Attorney, Agent, or Firm*—Whittemore, Hulbert & Belknap

[57] ABSTRACT

A vehicle window regulator employing a guide track and flexible rack rotary-to-linear motion converter, in which the track is bendable but rigid operationally and of T-shaped cross-section and the flexible rack comprises a strip with laterally offset, inwardly extending, longitudinally spaced integral flange portions at its opposite edges embracing the edges of the cross portion of the T-shaped track.

20 Claims, 10 Drawing Figures

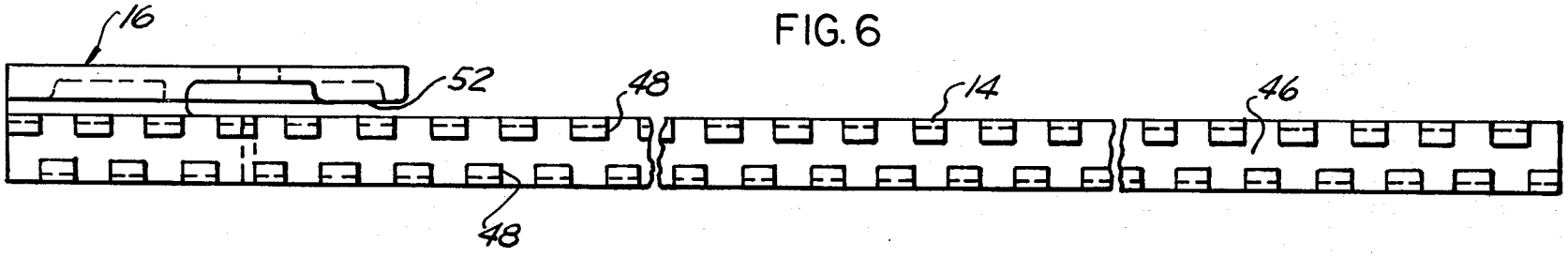
FIG. 6
FIG. 7
FIG. 8
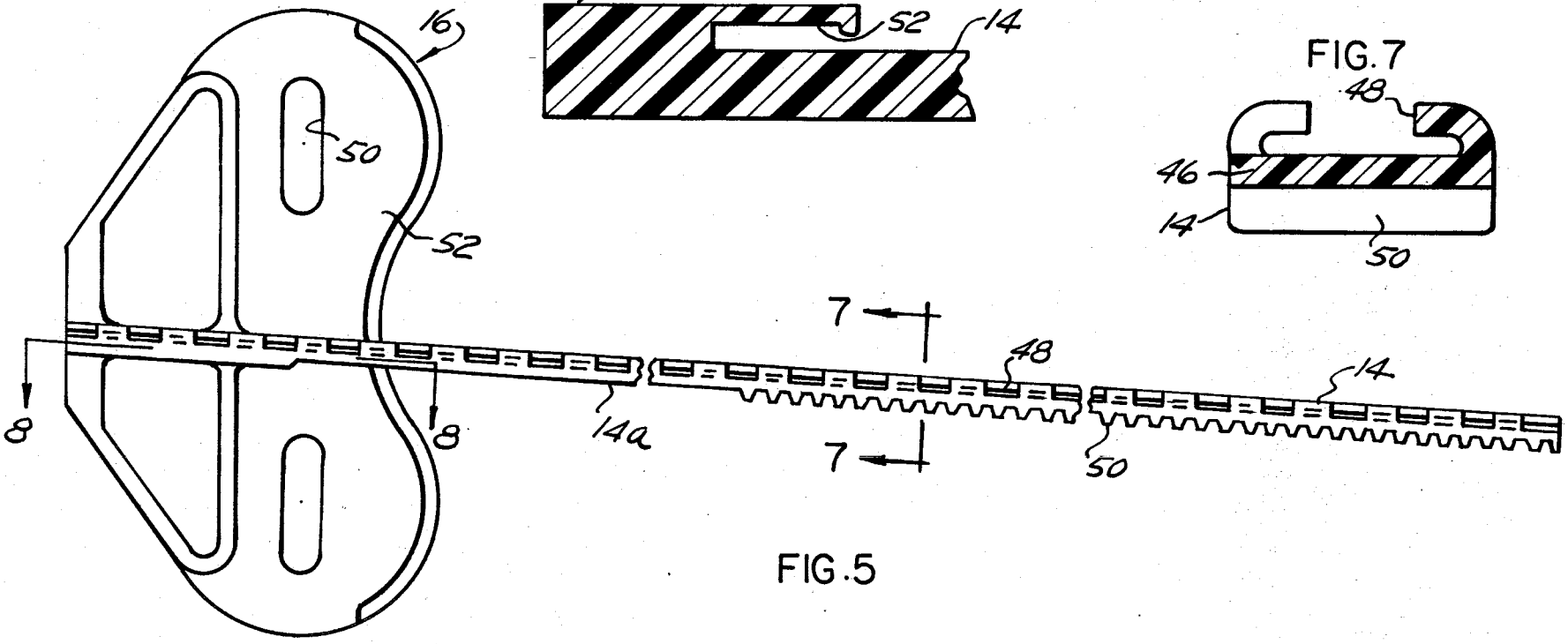
FIG. 5

WINDOW REGULATOR

BRIEF SUMMARY

The present invention relates to window regulating mechanism intended for use in a motor vehicle and adapted to be enclosed within a hollow door into which a window is lowered when moved from closed to open position. Operation of the mechanism is by rotation of a pinion, which may be power or manually actuated. Special means are provided for converting rotation of the pinion to linear movement of the window.

Prior U.S. Pat. No. 3,965,618 discloses mechanism of this general type in a window regulator, and prior U.S. Pat. No. 3,845,669 discloses details of a rotary-to-linear motion converter of a quite different construction.

The present invention includes a bendable but operationally rigid track, having a T-shaped cross-section in which the arms of the cross member of the T provide track flanges and the stem or central leg of the T provides the requisite stiffness and means for mounting the track. Preferably this track is metal and formed by bending an elongated strip into lengthwise folds which form the stem and cross member of the T of double strip thickness.

The rack preferably is formed of a suitable plastic such as nylon 101, comprises an elongated, flat intermediate strip provided at its edges with laterally offset, inwardly extending, longitudinally spaced integral retainers, cooperating with the strip to slidably engage the oppositely extending sides of the cross portions of the T-shaped track. The strip on its other side has integrally formed thereon a series of rack teeth. The length of the series of rack teeth slightly exceeds the required distance of linear travel and is shorter than the length of the rack member.

The rack is preferably a one-piece unitary construction, and also preferably includes an end enlargement for direct attachment to the bottom edge of the window, or to a bracket for this purpose.

BRIEF DESCRIPTION OF THE DRAWINGS

FIG. 5 is an elevational view of the rack.

FIG. 6 is an elevational view of the rack, viewed at 90° from the fiew of FIG. 5.

FIG. 7 is an enlarged sectional view on the line 7—7, FIG. 5.

FIG. 8 is an enlarged sectional view on the line 8—8, FIG. 5.

DETAILED DESCRIPTION

Figure 1:
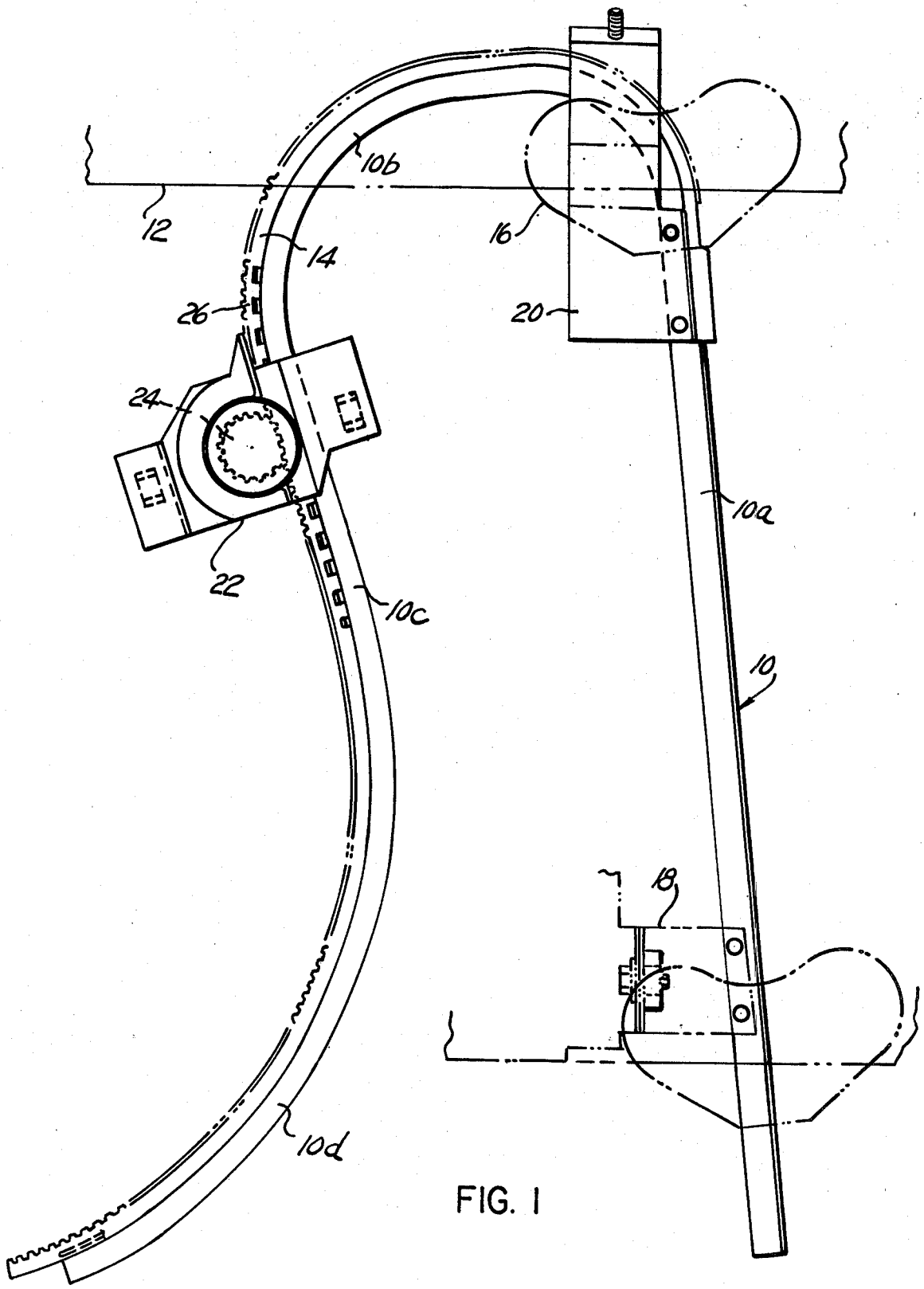
FIG. 1 is an elevational view of the window regulating mechanism.

Referring now to the drawings, the window regulator is illustrated in FIG. 1 as comprising a track 10 which is bendable into the configuration illustrated to conform it to the interior of a hollow vehicle door beneath the window opening therein. The track comprises a generally upright, substantially straight portion 10*a* which conforms to the path of a portion of the bottom edge of the glass window 12. It includes a curved lateral extension 10*b*, a downward extending portion 10*c*, and a reversely curved portion 10*d*.

Slidable longitudinally on the track 10 is a flexible driven member in the form of a rack 14 preferably formed of a suitable plastic such as nylon 101, and having a connector in the form of an enlargement 16, preferably integral therewith for attachment to the lower edge of the window 12.

The track is fixedly mounted within the hollow door below the window opening by brackets, two of which are shown at 18 and 20, and passes through a housing 22 containing a drive pinion 24 meshing with the rack teeth 26. Pinion 24 may be manually or motor driven to raise and lower the window.

Figure 2:
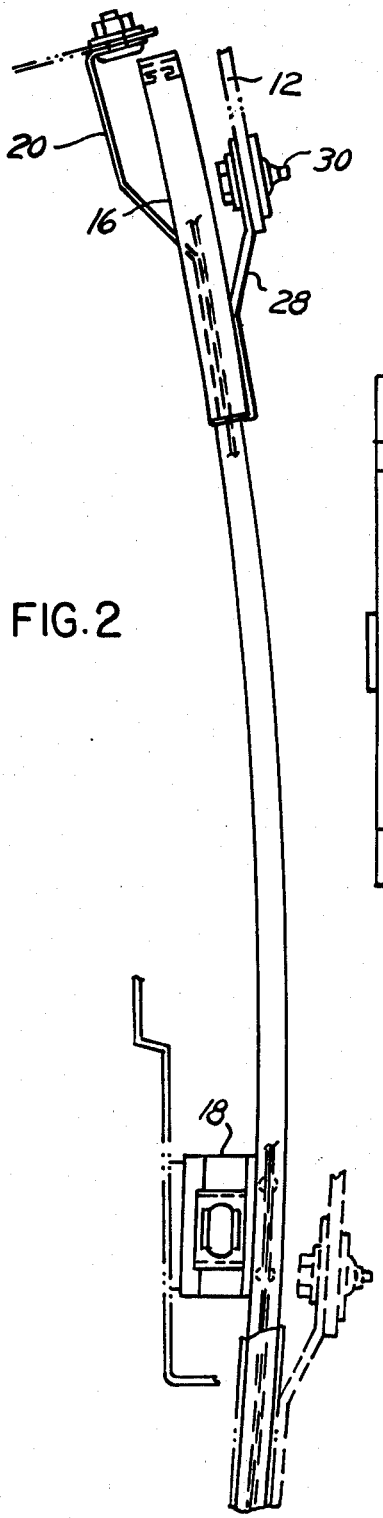
FIG. 2 is an enlarged fragmentary elevational view showing the mounting of the mechanism and its connection to a window.

In FIG. 2, the enlargement 16 of the rack 14 is shown as attached to the lower edge of the window by a bracket 28 and fasteners 30.

Figure 3:
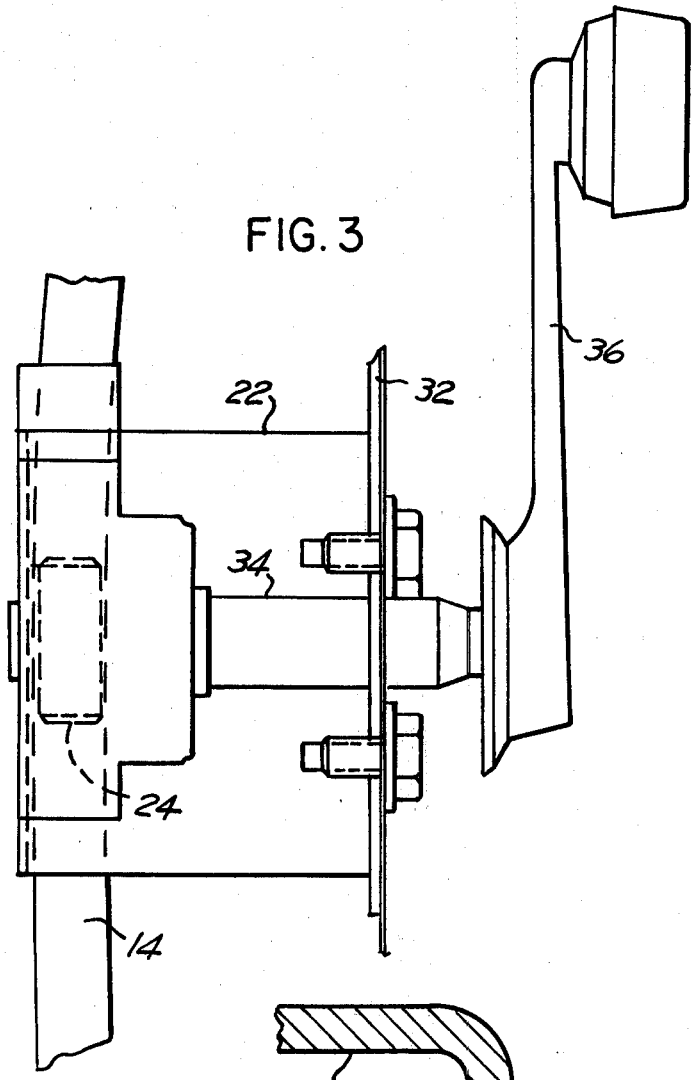
FIG. 3 is an enlarged elevational view of the operating mechanism.

The housing 22 as seen in FIG. 3 is mounted on the inner door panel 32 and includes a shaft 34 connected to pinion 24. Crank 36, for manual window operation, is connected to the end of shaft 34 and is accessible within the vehicle. Obviously, motor means may be housed within the hollow door and connected to shaft 34, if power operation is desired.

Figure 4:
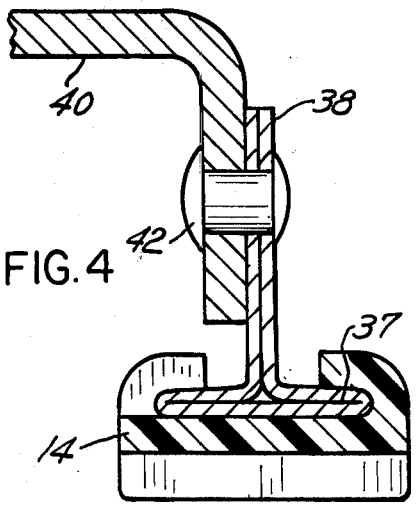
FIG. 4 is a greatly enlarged transverse sectional view through the track and rack.

The track 10 is preferably metal and may be formed from an elongated strip bent into a generally T-shaped cross-section as best illustrated in FIG. 4. The cross member of the T provides two elongated, oppositely extending guide flanges 37, which extend outwardly from the stem 38 of the T. The stem 38 provides means for mounting the track in fixed position, as by a bracket 40 shown as rivetted to leg 38 at 42.

The track illustrated in FIG. 4 is formed by bending a thin metal strip longitudinally into a T-shaped cross-section with the stem and cross member of the T of double strip thickness. The material of the track is preferably a steel having a thickness of 0.020"–0.030", and is fabricated in straight lengths and then bent into the required configuration. In use, and particularly as supported by a number of brackets, the track is operationally rigid.

The rack 14 is best illustrated in FIGS. 5–8. As seen in these Figures, the rack comprises an elongated intermediate flap strip 46 provided at one side and at opposite edges thereof with a multiplicity of laterally offset, inwardly extending, longitudinally spaced retainer portions 48. As best seen in FIG. 6, each retainer 48 is coextensive with and located directly opposite to a space between a pair of adjacent retainers on the other edge of the strip. The retainers are arranged with the strip 46 to provide free but accurately guided movement of the flexible rack on the track.

At the other side of the strip 46, the rack 14 is provided with a series of rack teeth 50.

The rack, designated in its entirety at 14, has rack teeth provided only for a portion of its length as necessary to provide the required window movement. The location of the toothed portion is of course determined by the location of the drive pinion 24. The portion of the rack adjacent the enlarged end portion 16 is devoid of teeth as indicated at 14*a*.

It will be observed that in the preferred arrangement of retainers 48, they are spaced apart a distance equal to their width, and are staggered at opposite edges so that each retainer is directly opposite to and coextensive with a space between a pair of adjacent retainers at the opposite edge of the intermediate strip.

One end of the rack 14 comprises the transversely extending head 16 which is integral with the rack and includes openings 50 to provide stable connection to corresponding openings in the lower edge of a windowpane, or in a bracket for connection to the windowpane. The head includes a portion which is spaced from an edge of the main elongated rack as indicated at 52.

It will be observed in FIG. 1 that at one limiting position, the connector 16 at one end of said driven member 14 is adjacent the lower end of the straight portion 10*a* of the track, and at the other limiting position, the connector 16 is adjacent the other end of the straight track portion 10*a*.

It will further be apparent that the driven member need be provided with rack teeth for a distance corresponding to the required travel of said driven member, or the length of the straight track portion.

Figures 9, 10:
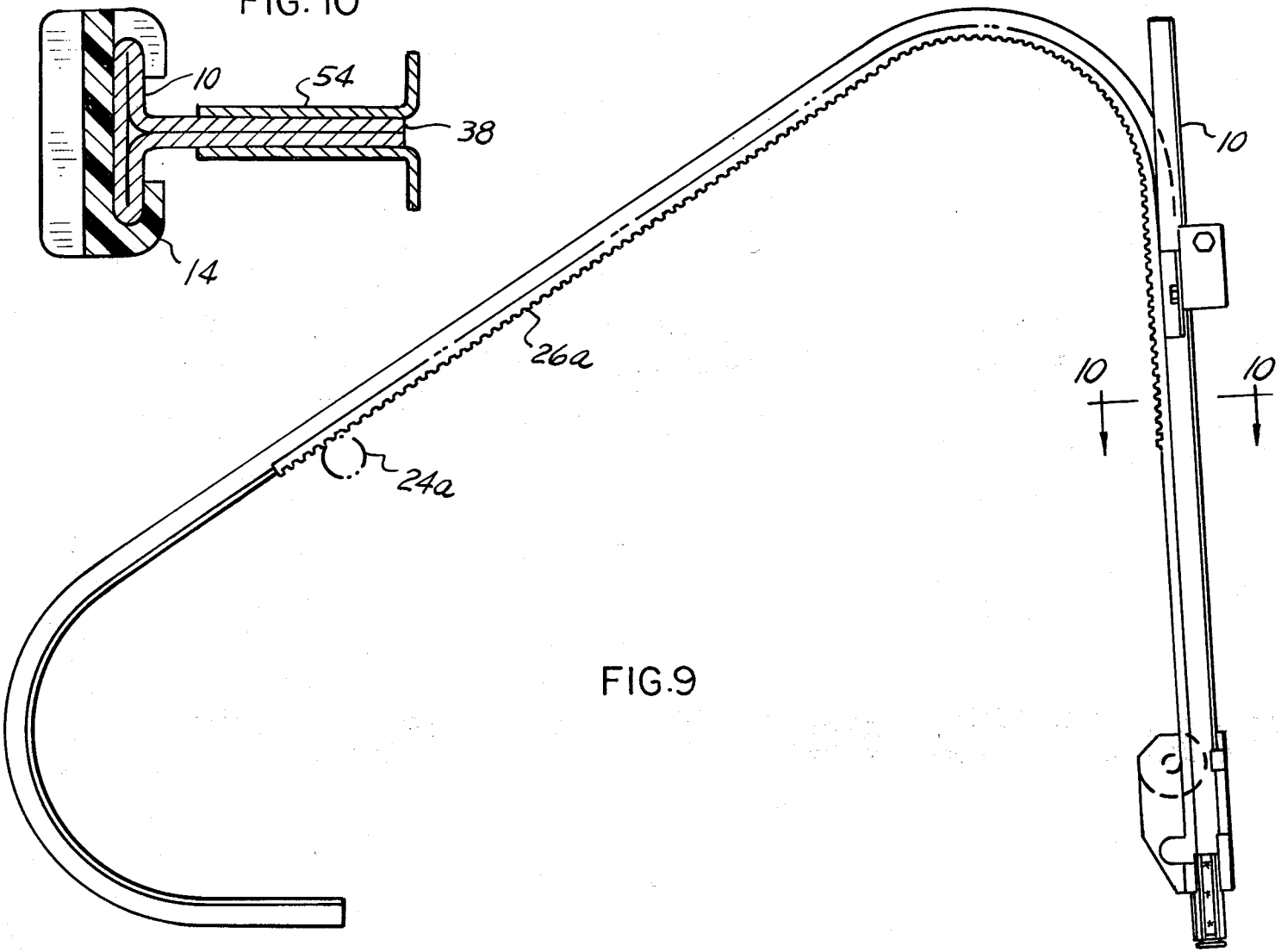
FIG. 9 is an elevational view similar to FIG. 1, but with the rack reversed.
FIG. 10 is an enlarged sectional view through the track, rack, and a mounting bracket.

Referring now to FIG. 9, it will be seen that the rack and track may be reversed from the position seen in FIG. 1, so that the rack teeth, here seen at 26*a*, will be at the left of the track 10, rather than at the right thereof, as seen in FIG. 1. This of course requires the drive pinion to occupy the position seen at 24*a*.

In FIG. 10 there is illustrated a pair of angle members 54 fastened to the stem 38 of the T-shaped track 10, constituting brackets by means of which the track may be mounted to the door structure. Since the track 10 as described, while bendable to conform to a desired path, remains rigid in operation, it is referred to in the broadest sense as functionally rigid.

What is claimed is:

1. A rotary-to-linear motion converting device comprising an elongated bendable but operationally rigid track having a generally T-shaped cross-section in which the cross member of the T forms oppositely extending guide flanges, an elongated flexible rack having an intermediate strip provided at its opposite edges with retainers spaced laterally from one side of the strip and extending inwardly thereof toward each other and engaging the guide flanges of the track and supporting said rack for sliding motion longitudinally of said track, and a series of rack teeth on the other side of said strip.

2. A device as defined in claim 1, comprising a rotatable drive gear in mesh with said rack.

3. A device as defined in claim 1, in which said track is formed of metal.

4. A device as defined in claim 1, in which said track is formed of an elongated strip of sheet metal bent longitudinally into T-shaped configuration.

5. A device as defined in claim 3, in which the strip of sheet metal is bent to provide the stem and cross member of the T shape are of two-ply construction.

6. A device as defined in claim 1, in which the flexible rack is formed of plastic.

7. A device as defined in claim 6, in which the retainers on said rack comprise longitudinally spaced elements integral with said strip.

8. A device as defined in claim 7, in which the spaced elements at opposite edges of said strip are staggered.

9. A device as defined in claim 8, in which each element at one edge of said strip is coextensive with and located directly opposite to a space between a pair of adjacent elements on the opposite edge of said strip.

10. A window regulator for a vehicle window comprising an elongated bendable but operationally rigid track having a generally T-shaped cross-section in which the cross member of the T provides oppositely extending guide flanges, an elongated flexible plastic rack comprising an intermediate strip having at opposite edges thereof integrally formed retainers spaced laterally from said one side of said strip toward each other and engaging said guide flanges and supporting said rack for sliding motion longitudinally of said track, rack teeth integrally formed on the other side of said strip, said rack having means thereon for attachment to the bottom window edge, said track having a portion shaped to conform to the path of movement of the bottom edge of the window and an extension curved to extend away from said path, a pinion in mesh with said rack teeth, and means for rotating said pinion to drive said rack longitudinally and to move said window.

11. A regulator as defined in claim 10, in which the window is slidable vertically in a hollow door construction, said track having an approximately vertical portion of a length to provide the required vertical movement of the window between open and closed position, and having an extension curved to be fully enclosed within the hollow door construction.

12. A regulator as defined in claim 11, which comprises a support within said door construction for supporting said pinion in mesh with said rack teeth.

13. A regulator as defined in claim 12, comprising a manually operable crank extending through the inner wall of said hollow door construction and operatively connected to said pinion.

14. A regulator as defined in claim 10, in which the means on said rack for attachment to a window comprises an integrally formed head extending transversely from one edge of the intermediate strip thereof at an end of said rack.

15. A regulator as defined in claim 14, said head having openings therein spaced substantially from said main rack portion for stable attachment to a bracket or window edge.

16. A rotary to linear motion converting device comprising a functionally rigid track member having an elongated guide strip portion and track mounting means connected to said strip portion at one side thereof, an elongated flexible follower member formed of plastic material comprising an elongated flat portion provided at its edges with flange forming portions extending in the same direction from one side of the flat portion and thence inwardly toward each other and embracing the edge portions of said guide strip portion of said track to provide for only relative longitudinal sliding motion between said members, and rotary means operably connected to said flexible follower member to apply longitudinally directed forces thereto to drive said flexible follower member slidably longitudinally on said track member.

17. A device as defined in claim 16, in which the flat portion of said flexible member is provided with teeth at the side thereof opposite said flange forming portions with rack teeth, and said rotary means comprises a pinion in mesh with said rack.

18. A device as defined in claim 16, in which said flange forming portions at each edge of the elongated flat portion of said flexible member are in the form of longitudinally separated elements integral with the flat portion of said flexible member.

19. A device as defined in claim 18, in which the elements at each side of the flat portion of said flexible member are spaced apart longitudinally of said flexible member a distance substantially equal to the width of each element measured longitudinally of said flexible member.

20. A device as defined in claim 19, in which the elements at opposite edges of the flat portion of said flexible member are staggered.

* * * * *